US006374760B1

(12) United States Patent
Moore, III

(10) Patent No.: US 6,374,760 B1
(45) Date of Patent: Apr. 23, 2002

(54) CAP FRAME DRIVE ASSEMBLY AND METHOD

(76) Inventor: E. Frank Moore, III, 4447 Old Randleman Rd., Greensboro, NC (US) 27406

( * ) Notice: Subject to any disclaimer, the term of this patent is extended or adjusted under 35 U.S.C. 154(b) by 0 days.

(21) Appl. No.: 09/804,318

(22) Filed: Mar. 12, 2001

(51) Int. Cl.[7] ..... D05C 9/04

(52) U.S. Cl. ..... 112/470.18; 112/475.18; 112/103

(58) Field of Search ..... 112/470.18, 470.14, 112/475.11, 470.09, 470.17, 425.18, 103

(56) References Cited

U.S. PATENT DOCUMENTS

| | | | | |
|---|---|---|---|---|
| 4,665,844 A | | 5/1987 | Shibata | |
| 4,998,964 A | | 3/1991 | Golia | |
| 5,507,241 A | | 4/1996 | Evans | |
| 5,553,560 A | | 9/1996 | Tajima et al. | |
| 5,590,613 A | | 1/1997 | Head | |
| 5,915,314 A | | 6/1999 | Moore, III | |
| 6,065,413 A | * | 5/2000 | Kawaguchi | 112/470.14 |
| 6,227,129 B1 | * | 5/2001 | Parker, Jr. | 112/103 |

FOREIGN PATENT DOCUMENTS

| | | |
|---|---|---|
| DE | 41 39 756 A 1 | 12/1991 |

* cited by examiner

*Primary Examiner*—Ismael Izaguirre

(57) ABSTRACT

A cap frame drive assembly and method provides for a quick and easy setup for embroidering, sewing or stitching on curved articles such as baseball caps. The preferred form of the cap frame drive assembly utilizes a pair of cam mechanisms to affix the drive frame to the pantograph while a conventional belt attached to a rotational drive platform affixed to the pantograph rotates the drive cylinder during sewing.

19 Claims, 9 Drawing Sheets

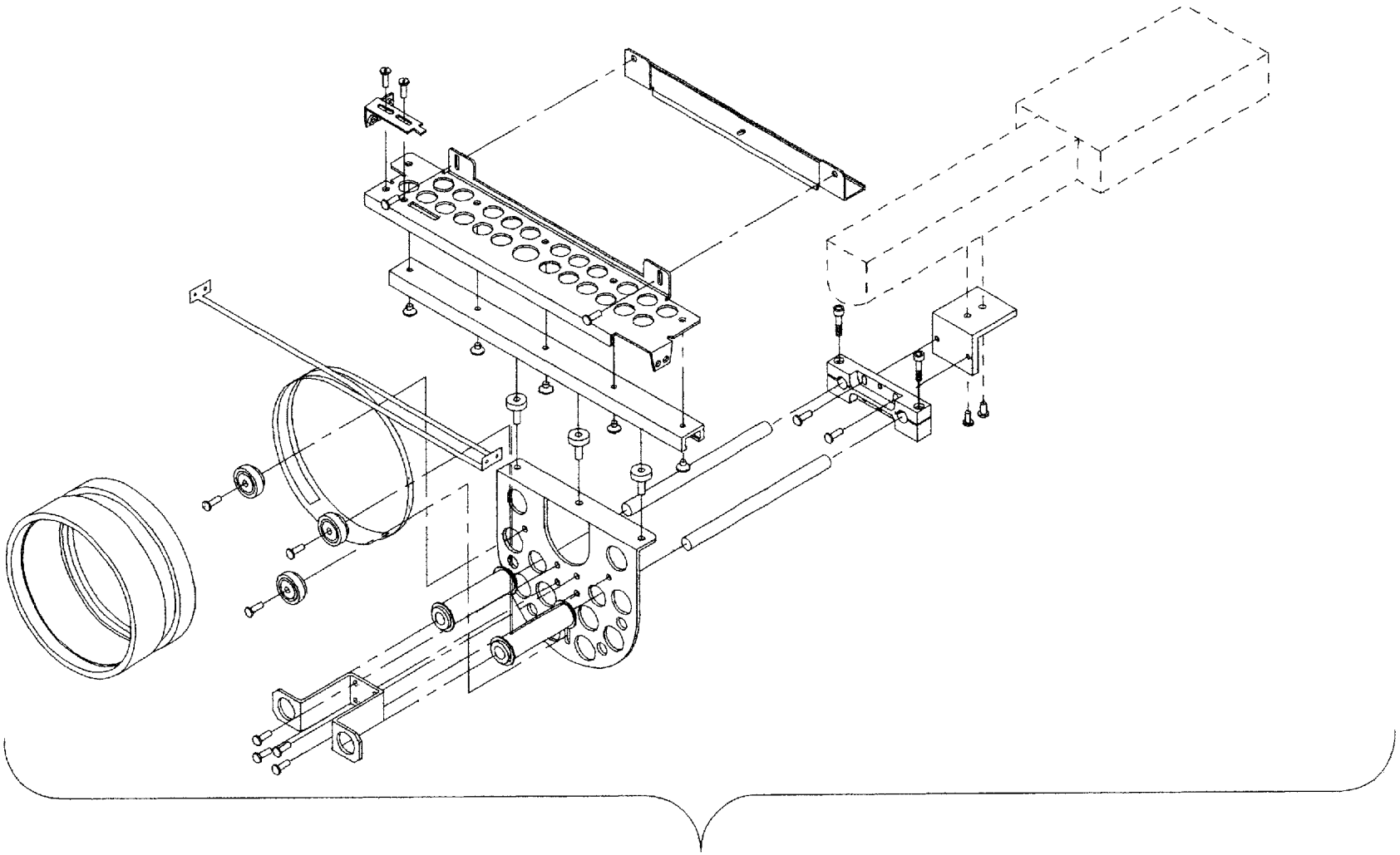
PRIOR ART FIG. 9

CAP FRAME DRIVE ASSEMBLY AND METHOD

FIELD OF THE INVENTION

The invention herein pertains to stitching and embroidering on curved articles such as caps and particularly pertains to a cap frame drive assembly as used on conventional multi-head sewing machines.

DESCRIPTION OF THE PRIOR ART AND OBJECTIVES OF THE INVENTION

With the cost of labor and other expenses escalating rapidly in recent years, sewing and embroidering shops have attempted to reduce costs and increase profits through the use of modern equipment including multi-head sewing machines which may have ten or more sewing "heads" or stations. These machines are used for flat goods such as jackets, shirts and the like and can be converted for curved articles such as baseball and similar caps. As it is rare to embroider or sew on only curved articles, most machine operators are required to change from flat goods to caps often, even though such changes require wasted machine downtime and labor. As multi-head sewing machines utilize pantographs to duplicate stitching from station to station it has been necessary to provide drive frames for curved articles which can be set up efficiently and properly once attached. While drive frame assemblies on multi-head sewing machines for cap and other curved articles are well known, such prior devices generally require several hours of downtime for attachment and changeover from flat goods to curved articles such as caps.

Thus, with the known problems and disadvantages of using prior curved article drive assemblies, it is an objective of the present invention to provide a drive assembly for a multi-head sewing machine which is easy to attach and remove as required.

It is an objective of the present invention to provide a cap frame drive assembly which includes a drive base having a pair of cam mechanisms affixed thereto for quick attachment and release.

It is still another objective of the present invention to provide a drive base utilizing a drive cylinder and a drive belt which is affixed to a rotational drive platform on the sewing machine pantograph.

It is a further objective of the present invention to provide a drive base which can be permanently attached for long runs to a pantograph with simple machine screws or bolts in little time.

It is yet another objective of the present invention to provide a method of attaching a drive assembly for curved articles which can be quickly learned by relatively inexperienced personnel.

Various other objectives and advantages of the present invention will become apparent to those skilled in the art as a more detailed description is set forth below.

SUMMARY OF THE INVENTION

The aforesaid and other objectives are realized by providing a cap frame drive assembly which can be releasably affixed to a conventional pantograph of a multi-head sewing machine as used for embroidering, sewing, stitching, monograms, logos, names and the like on baseball and other caps and other curved articles. In the preferred method of attachment, a drive base having a pair of vertical latch pins is positioned with the latch pins in apertures of the pantograph. A pair of cam mechanisms are then manually actuated to drive cam followers against the edge of the pantograph causing the drive base to move in a forward direction, from the pantograph and allowing engagement of the latch pins with the aperture walls. Rotating levers which are attached to cams provide quick attachment or release as desired. In an alternate embodiment, the pantograph drive base is simply bolted to the pantograph. Both embodiments utilize a series of wheels which allow rotation of a drive cylinder driven by a belt secured to a rotational drive platform, also affixed to the pantograph. A guide or leveling shim, formed preferably from felt allows proper vertical positioning of the drive base at each station, relative to the top of the sewing arm.

BRIEF DESCRIPTION OF THE DRAWINGS

FIG. 9 shows an exploded view of a prior art cap frame drive assembly for a multi-head sewing machine as known in the art; and

DETAILED DESCRIPTION OF THE PREFERRED EMBODIMENTS AND OPERATION OF THE INVENTION

Figure 1:
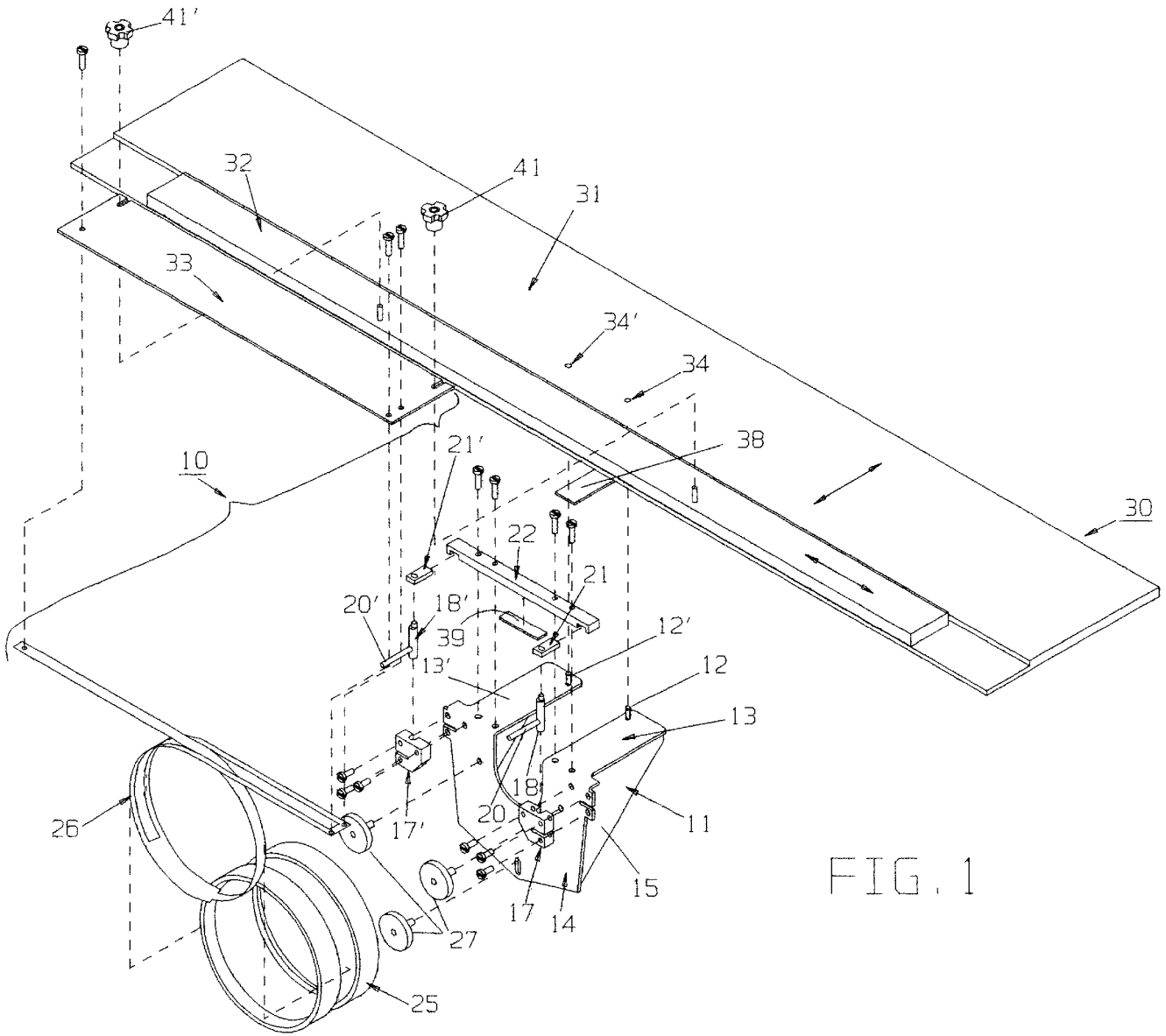
FIG. 1 illustrates the preferred form of the invention in an exploded fashion.

For a better understanding of the invention and its method of operation, turning now to the drawings, FIG. 1 demonstrates preferred cap frame drive assembly 10 in exploded fashion, apart from pantograph 30 which, as would be understood would be connected to a commercial multi-head sewing machine as used for embroidering, sewing and the like. Cap frame drive assembly 10 is shown for one sewing station, though a plurality would generally be used, includes drive cylinder 25 for holding curved articles such as baseball caps or the like thereon for stitching, sewing and embroidering purposes. Also included are belt 26, wheels 27, drive base 11, cam mechanism 16, 16' (within mounting blocks 17, 17' respectively) with cams 18, 18' with levers 20, 20', cam followers 21, 21', cam follower guide 22, leveling pad 39, rotational drive platform 33, drive base 11 including horizontal sections 13, 13' and vertical section 14. Cap frame drive assembly 10 illustrates only the components for one sewing head or station. Ten such drive assemblies for a typical ten sewing head machine would be required. Pantograph 30 would, of course extend therealong to accommodate all ten sewing heads (not shown) and rotational drive platforms 33 for each station would also be needed.

Figure 2:
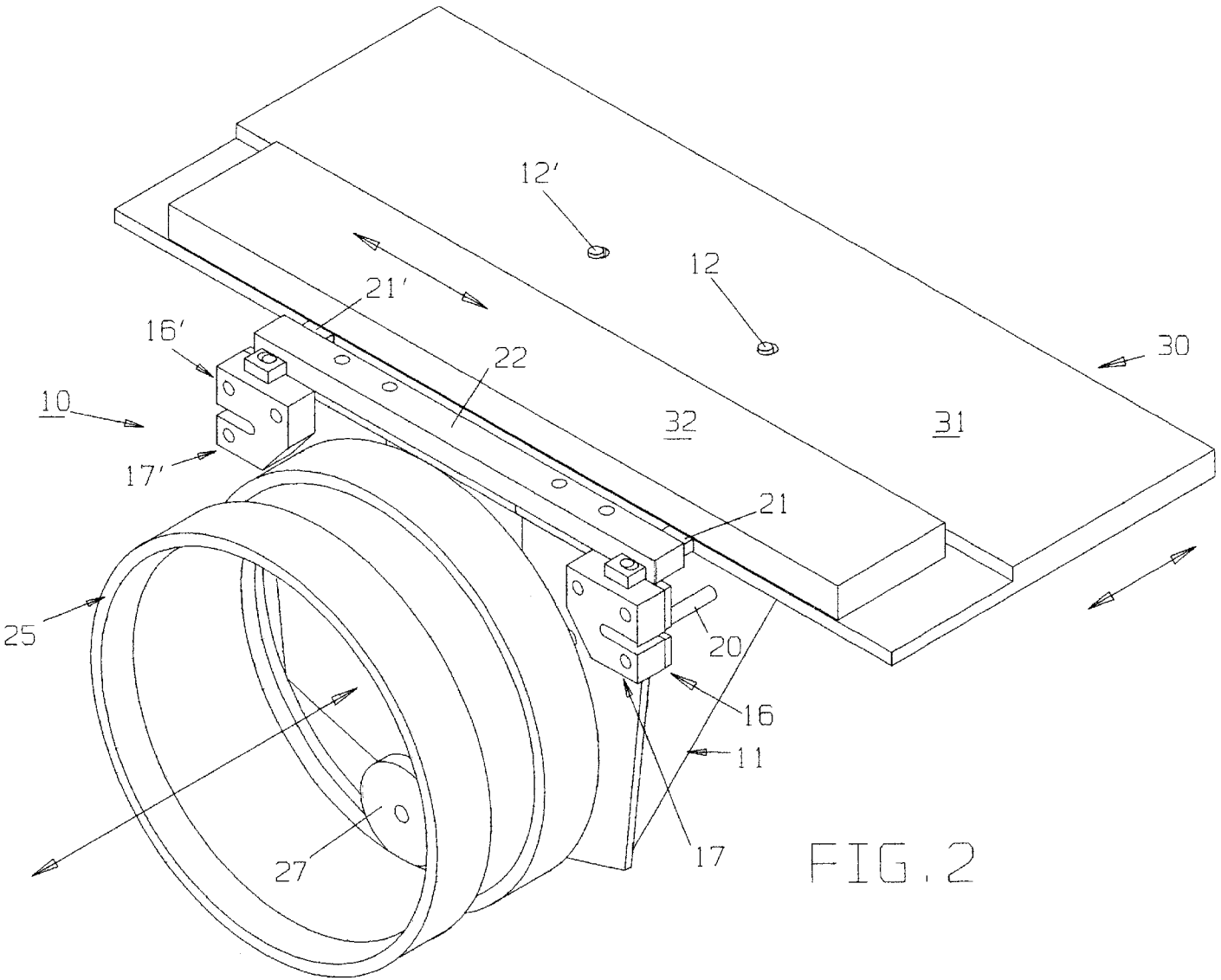
FIG. 2 shows an enlarged view of the drive frame affixed to the pantograph with the drive cylinder attached.

In FIG. 2, drive cylinder 25 is positioned on drive base 11 which in turn is releasably connected to pantograph 30. Pantograph 30 is generally, computer operated as is conventional in the industry and includes longitudinal platform 31 and lateral platform 32. Longitudinal platform 31 operates to drive pantograph 30 in a forward to rearward direction, parallel to the axial direction of drive cylinder 25. Lateral platform 32 directs drive cylinder 25 rotationally during sewing.

Figure 7:
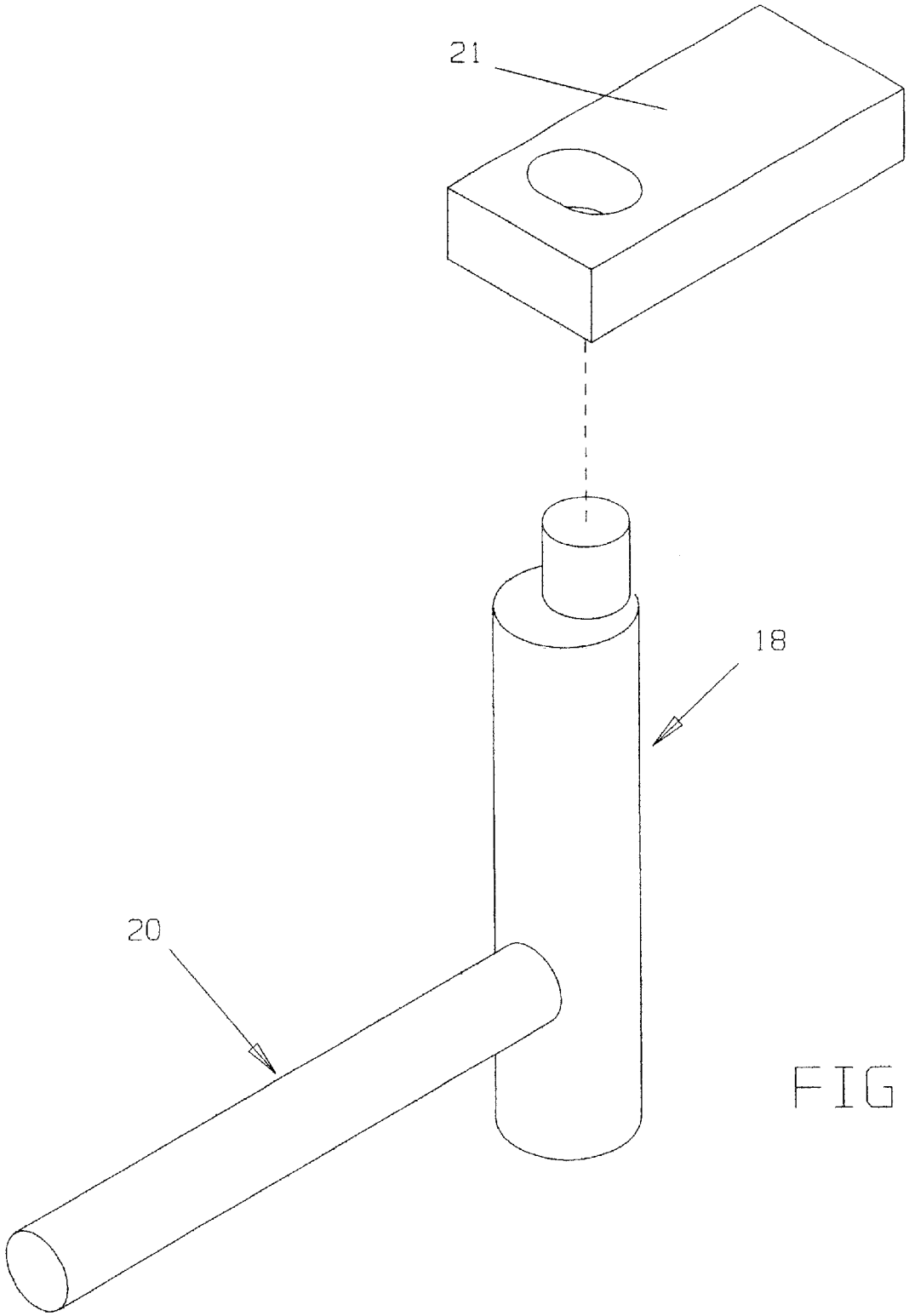
FIG. 7 illustrates an enlarged view of the cam as removed from the cam mounting block and exploded from the cam follower.

The operation of multi-head sewing machines is expensive and factory owners must continuously run these machines to realize a profit. However, due to customer demand and changing market conditions, such multi-head sewing machines are frequently operated on a variety of goods such as jackets, t-shirts, caps and the like, causing sewing machine operators to make frequent machine setups. Such setups are normally time consuming and for a ten head sewing machine, it may take an experienced operator three or more hours to install or attach ten conventional cap frame drive assemblies. Once the caps have been sewn as ordered, the cap frame drive assemblies must be removed for sewing on conventional flat goods such as sweatshirts or jackets. The present invention remedies this time consuming problem. Preferred drive assembly 10 allows for quick and easy assembly and attachment by inexperienced persons. As shown in FIG. 2, cam mechanisms 16, 16' can easily be manually grasped and cam levers 20, 20' rotated from a locked position (shown in FIGS. 2, 3C, 4C and 5C) to an intermediate position (shown in FIGS. 3B, 4B and 5B) to an open or unlocked position (shown in FIGS. 3A, 4A and 5A). Drive assembly 10 can then be easily removed from pantograph 30. Rotational drive platform 33 which is affixed to the front edge of lateral platform 32 by thumbscrews 41, 41' (FIG. 1) can likewise be quickly removed. Thus, with thumbscrews 41, 41' loosened and cam levers 20, 20' in a forward direction (shown in FIG. 3A), cap frame drive assembly 10 can be removed in a matter of seconds and the sewing station is then ready for sewing or stitching on flat goods once again. Cam levers 20, 20' are attached respectively to cams 18, 18' (lever 20 seen enlarged in FIG. 7 with cam follower 21 exploded therefrom). With latch pins 12, 12' positioned in apertures 34, 34' of pantograph 30, cams 18, 18' are rotated to urge cam followers 21, 21' in a longitudinal (front to back) direction as they pass through follower guide 22 into contact with longitudinal platform 31 (seen in FIGS. 3A–3C, 4A–4C, and 6A–6B) for a closed or locked posture.

As cam followers 21, 21' urge lateral platform 32 rearwardly, first latch pin 12 positioned in aperture 34 and second latch pin 12' positioned in second longitudinal aperture 34' move into engagement with walls 35, 35' (FIGS. 6A–B) and lips 19, 19' (19' not shown on longitudinal platform 31 in FIGS. 6A–B) to thereby hold cap frame drive assembly 10 in secure engagement with pantograph 30. Drive cylinder 25 has been previously placed on wheels 27 for rotational purposes and drive belt 26 having been affixed to rotational drive platform 33 is joined to lateral platform 32 as usual and the station setup is then complete for engagement with a particular cap frame.

Figure 8:
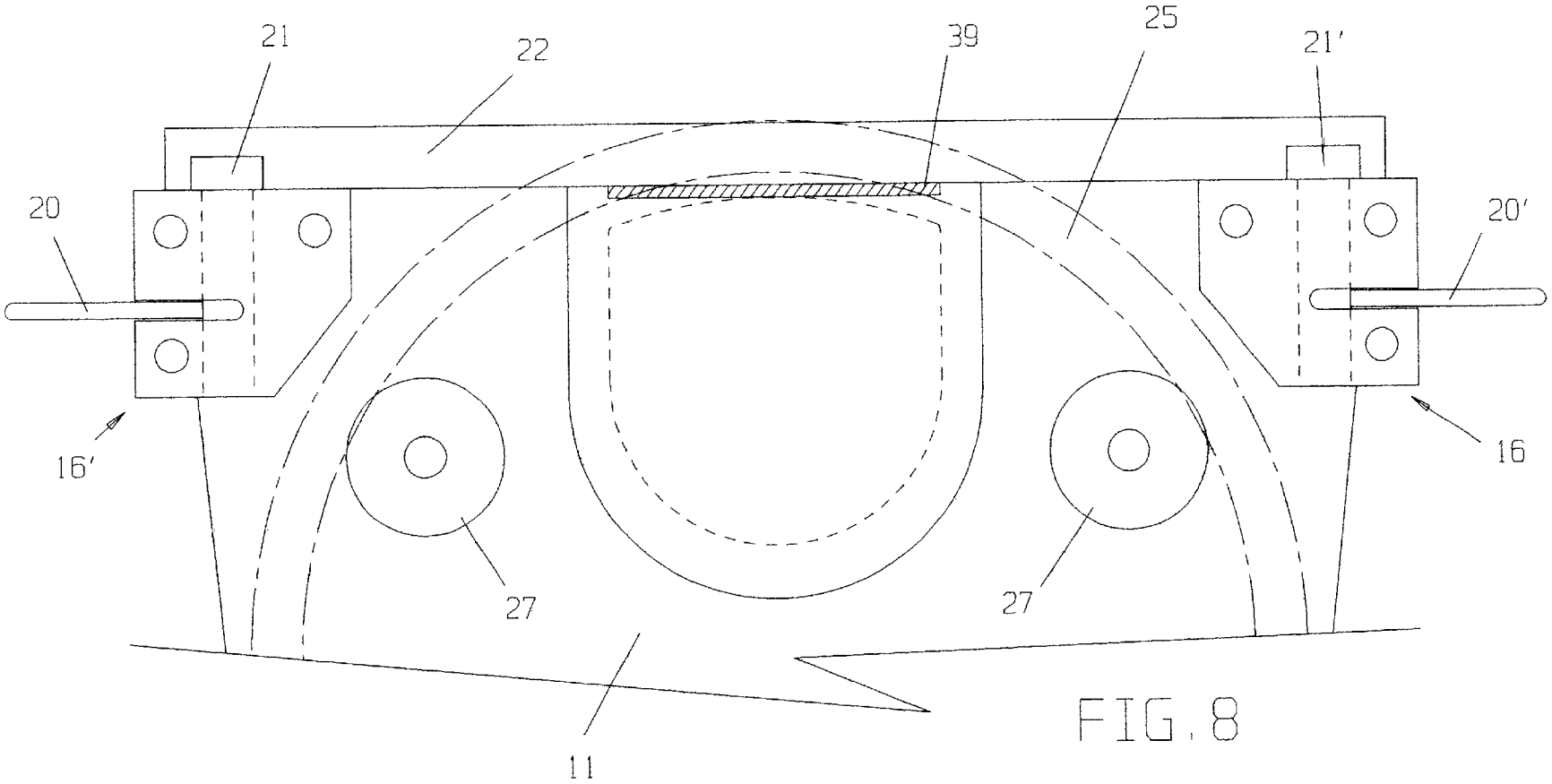
FIG. 8 demonstrates a front view of the follower guide with the cam mechanisms attached.

As further shown in FIG. 1, cam follower guide 22 is affixed to drive base 11, preferably by machine bolts though other fasteners may be used. Follower guide 22 is slotted to accommodate the movement therethrough of cam followers 21, 21', as also shown in FIG. 1. Follower guide shim pad 39 is attached beneath cam follower guide 22 such as with an adhesive or the like to properly position drive base 11 atop the sewing arm (shown in FIG. 8). Shim pad 38 is conventionally installed beneath longitudinal platform 31 which also rides atop the sewing arm. Dual cam mechanisms 16, 16' affixed to drive base 11 simplifies and greatly reduces the setup time versus the setup time required for prior art cap frame drive assemblies as shown in FIG. 9.

An alternate, but slower means of attachment of the drive assembly is also available for a more permanent setup such as when long runs for curved articles is anticipated. In such instances, drive base 11 is bolted onto pantograph 30 whereby cam mechanisms 16, 16' as shown in FIG. 2 are not utilized. In this alternate embodiment, rotational drive platform 33 would still be affixed to operate belt 26, rotating drive cylinder 25 as previously explained. Bolts, screws, rivets or other fasteners could be used (not seen) would pass through pantograph 30 into horizontal sections 13, 13' of drive base 14 to secure the same. With the removal of the mounting bolts, rotational drive platform 33, affixed by thumbscrews 41, 41', drive assembly 10 can be manually removed from the sewing machine.

Figure 3C:
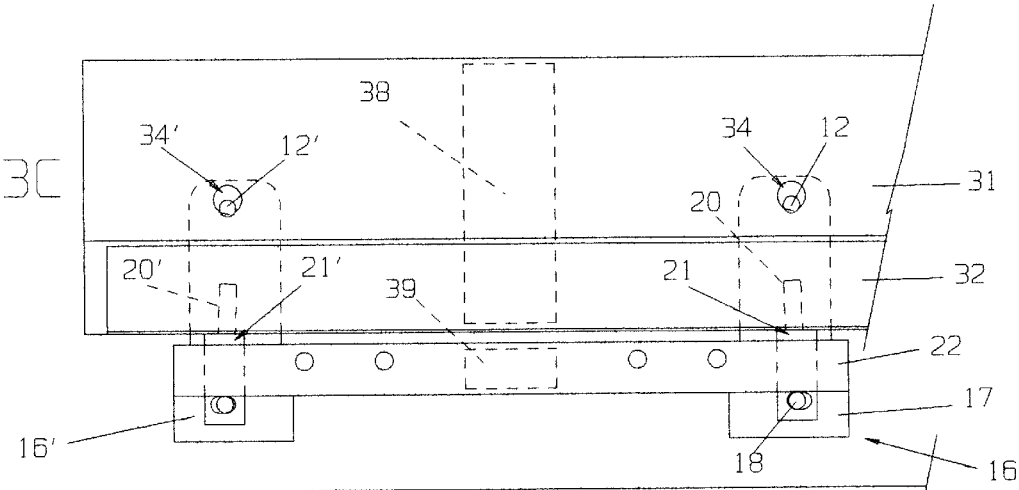
FIGS. 3A–3C demonstrate a top view of a portion of the pantograph at one station showing the cam mechanisms in an open, unlocked position in FIG. 3A, a partially closed position in FIG. 3B, and a fully locked position in FIG. 3C and with cam followers.
Figure 3B:
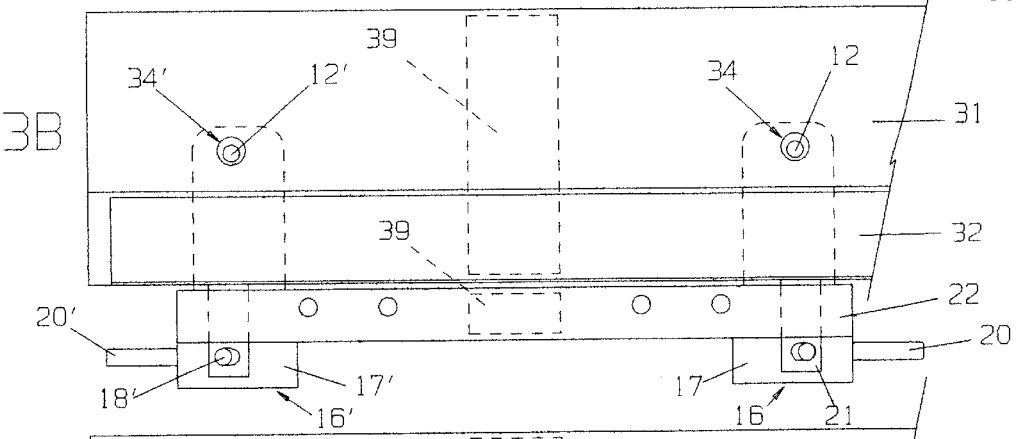
Figure 3A:
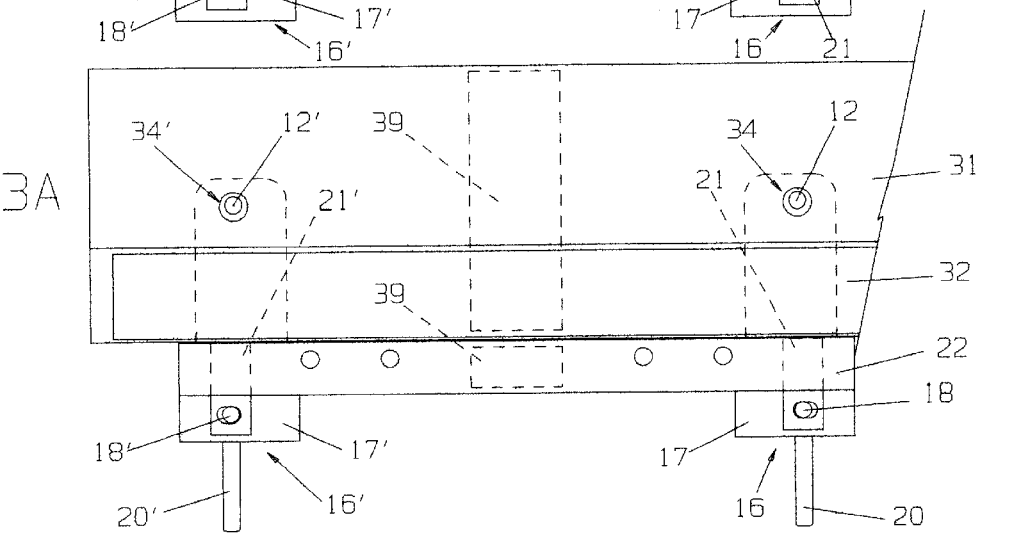
Figure 4A:
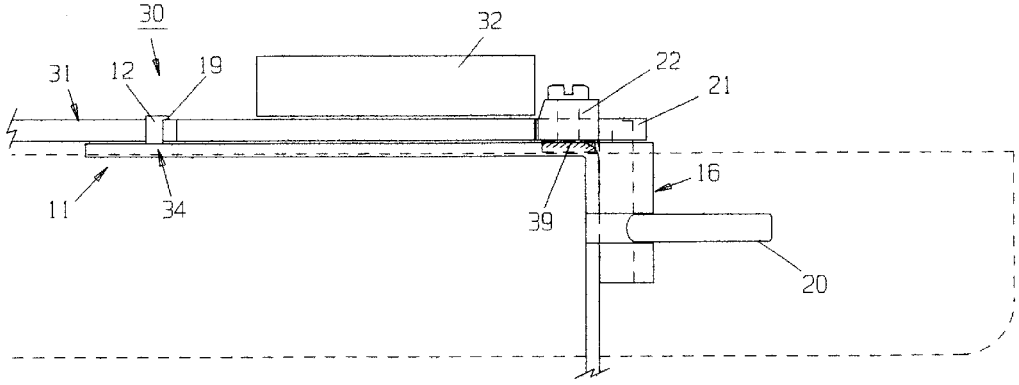
FIGS. 4A–4C feature a side view of the pantograph and drive frame cam mechanisms as shown in FIGS. 3A–3C in corresponding relation.
Figure 4B:
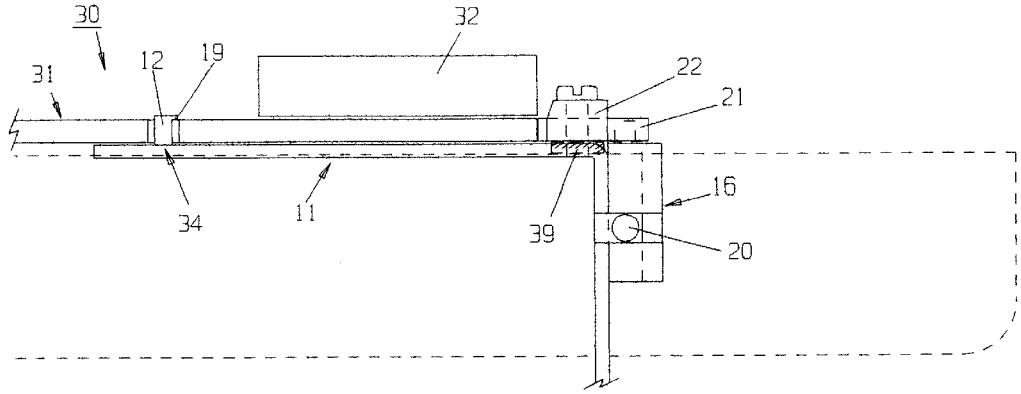
Figure 4C:
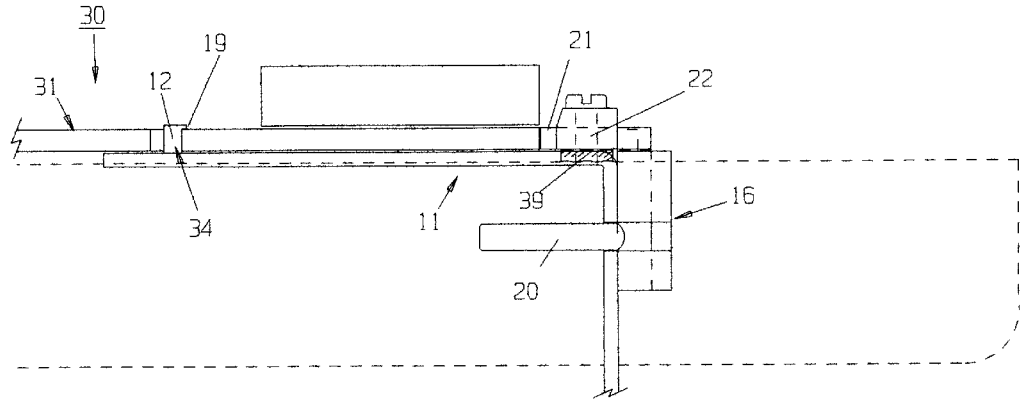
Figures 5A, 5B, 5C:
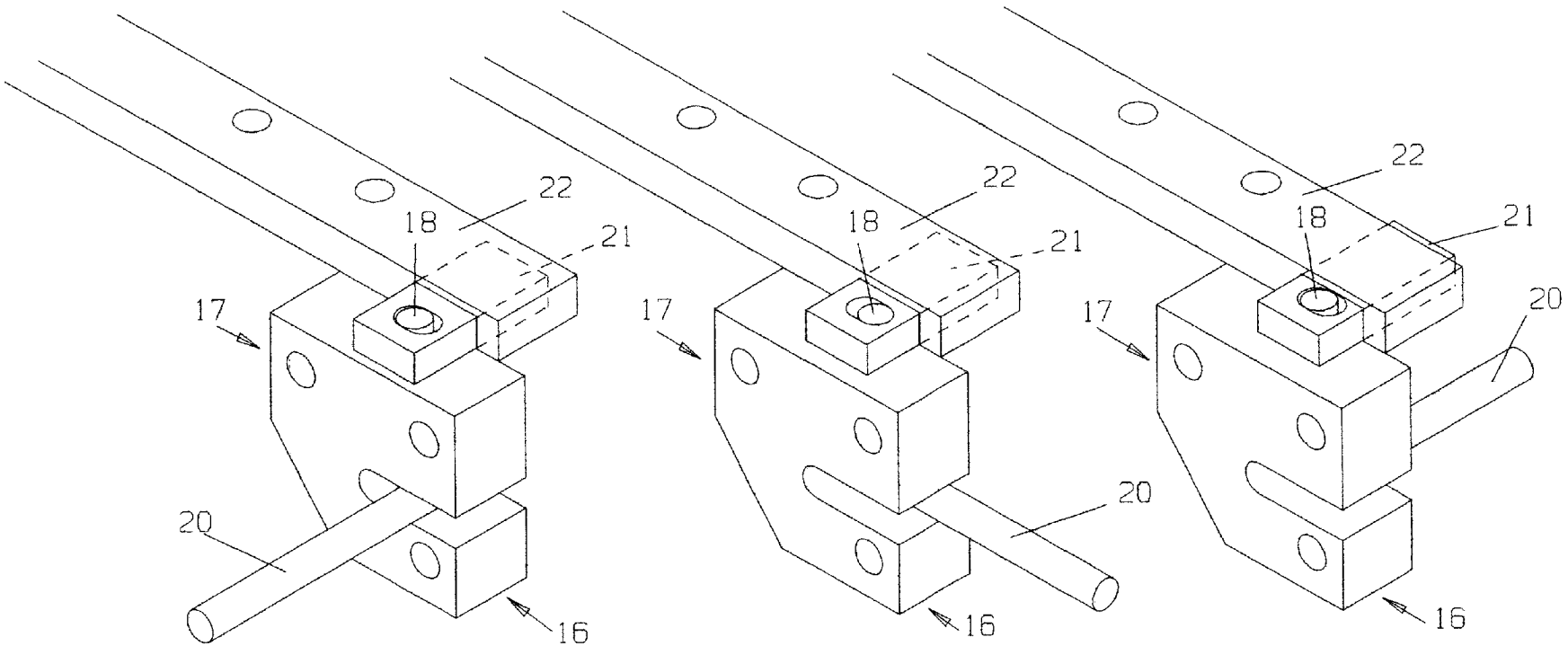
FIGS. 5A–5C depict an enlarged perspective view of the cam mechanisms attached to the cam follower guide in corresponding relation to those shown in FIGS. 3A–C.
Figures 6A, 6B:
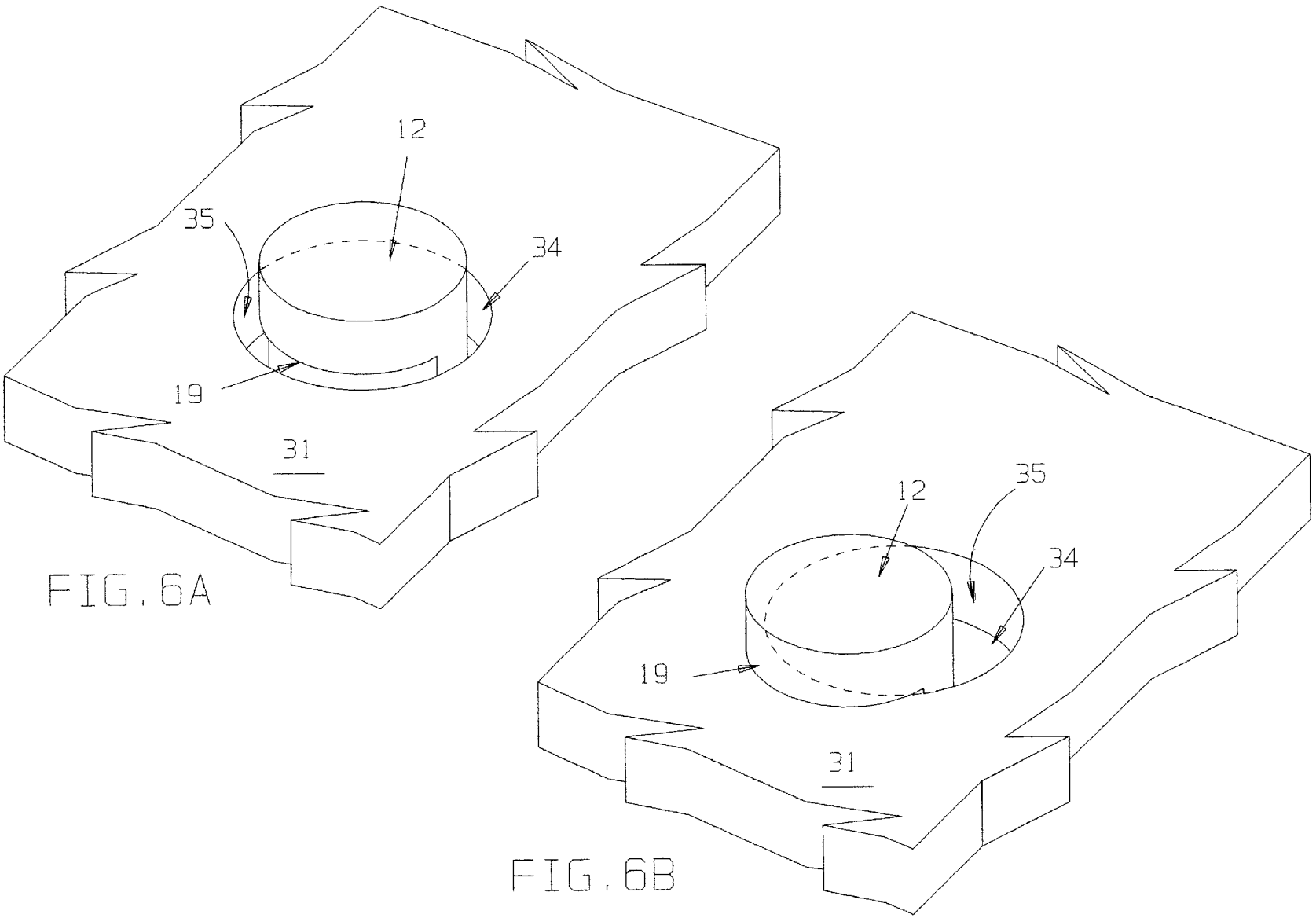
FIGS. 6A–6B picture enlarged views of the latch pin in a released posture and in a locked posture.

The preferred method of affixing a cap frame drive base to a pantograph of a multi-head sewing machine includes positioning drive base 11 having a latch pin 12 thereon beneath pantograph 30. Next, drive base 11 is lifted whereby latch pins 12, 12' of the drive base penetrate pantograph apertures 34, 34' respectively in longitudinal platform 31. Next, cam mechanisms 16, 16' which are affixed to drive base 11 are rotated by manually turning levers 20, 20' respectively as shown in FIG. 3A–C to drive cam followers 21, 21' against longitudinal platform 31 (FIG. 1) causing latch pins 12, 12' to respectively engage aperture walls 35., 35' (FIGS. 6A–B) thereby securely grasping drive base 11 against pantograph 30. Follower guide leveling or shim pad 39 is preferably positioned beneath cam follower guide 22 to position cam follower 22 at the correct height as seen in FIGS. 4A–C. Cap frame drive assembly 10 which has been preassembled is attached to pantograph 30 by affixing drive platform 33 to lateral platform 32 by thumbscrews 41, 41'.

As would be understood, variations can be made to the cap frame drive assembly and methods of installation as discussed herein and the illustrations and examples provided are for explanatory purposes and are not intended to limit the scope of the appended claims.

I claim:

1. A cap frame drive assembly for a pantograph of a multi-head sewing machine comprising:

a drive base, a cam mechanism, said cam mechanism attached to said drive base, a rotational drive platform, said rotational drive platform and said drive base attached to said pantograph.

2. The cap frame drive assembly of claim 1 wherein said drive base comprises a latch pin, said latch pin for engaging said pantograph.

3. The cap frame drive assembly of claim 1 further comprising a cam follower guide, said cam follower guide attached to said drive base.

4. The cap frame drive assembly of claim 1 wherein said cam mechanism comprises a mounting block.

5. The cap frame drive assembly of claim 1 wherein said cam mechanism comprises a cam, a lever, said cam attached to said lever.

6. The cap frame drive assembly of claim 5 further comprising a cam follower, said cam follower contiguous said cam for movement therewith.

7. The cap frame drive assembly of claim 4 further comprising a cam, a lever, said cam contained within said mounting block, said lever attached to said cam for rotating the same.

8. The cap frame drive assembly of claim 1 wherein said drive base comprises a latch pin, said latch pin for engagement with an aperture defined by said pantograph.

9. A cap frame drive assembly for attachment to a pantograph of a multi-head sewing machine comprising:

a drive base, a first latch pin, said latch pin affixed to said drive base, said pantograph defining a first latch pin aperture, said first latch pin positioned within said first pantograph aperture, a first cam mechanism, said first cam mechanism attached to said drive base, said first cam mechanism comprising a cam follower, said cam follower for engaging said pantograph whereby rotating said cam mechanism will cause said first latch pin to engage said first pantograph aperture wall to maintain said drive base on said pantograph.

10. The cap frame drive assembly of claim 9 further comprising a second cam mechanism, said second cam mechanism attached to said drive base.

11. The cap frame drive assembly of claim 9 wherein said first cam mechanism comprises a cam, a cam lever, said cam lever attached to said cam, a cam mounting block, said cam positioned in said cam mounting block.

12. The cap frame drive assembly of claim 11 further comprising a cam follower guide, a cam follower, said cam follower contiguous said cam for slidable movement within said cam follower guide, said cam follower positioned on said drive base.

13. The cap frame drive assembly of claim 9 further comprising a drive cylinder, said drive cylinder positioned on said drive base for receiving a cap frame.

14. The cap frame drive assembly of claim 13 further comprising a drive belt, said drive belt engaging said drive cylinder, a rotational drive platform, said rotational drive platform affixed to said pantograph, said drive belt attached to said rotational drive platform whereby said pantograph will rotate said drive cylinder during sewing.

15. A method of attaching a drive base having a cam mechanism and a drive cylinder to a pantograph of a sewing machine comprising the steps of:

a) affixing a rotational drive platform to a pantograph;

b) affixing the drive base to a pantograph using the cam mechanism; and c) attaching the rotational drive platform to the drive cylinder with a belt.

16. The method of claim 15 wherein affixing the drive base to the pantograph comprises the step of positioning a drive base latch pin into an aperture of the pantograph and thereafter rotating the cam mechanism.

17. A method of releasably affixing a drive base having a latch pin and a cam mechanism with a cam follower to a sewing machine pantograph having an aperture comprising the steps of:

(a) positioning the drive base latch pin in the pantograph aperture;

(b) activating the cam mechanism to urge the cam follower against the pantograph; and (c) engaging the aperture walls with the latch pin.

18. The method of claim 17 wherein positioning the latch pin comprises positioning a latch pin having an upper lip, said upper lip gripping said pantograph.

19. The method of claim 17 wherein positioning the cam mechanism comprises the step of rotating a cam to urge the follower against the pantograph.

* * * * *